United States Patent [19]

Habert

[11] 3,941,112

[45] Mar. 2, 1976

[54] IGNITION DEVICE FOR INTERNAL COMBUSTION ENGINES

[75] Inventor: Roger Jean Habert, Paris, France

[73] Assignee: Ducellier et Cie, Paris, France

[22] Filed: June 19, 1974

[21] Appl. No.: 480,719

[30] Foreign Application Priority Data

June 22, 1973 France ..... 73.22873

[52] U.S. Cl. .. 123/148 E; 123/148 D; 123/148 DC; 315/224

[51] Int. Cl.[2] ..... F02P 3/04

[58] Field of Search ..... 123/148 D, 148 DC, 148 E; 315/224

[56] References Cited

UNITED STATES PATENTS

| | | | |
|---|---|---|---|
| 1,469,582 | 10/1923 | Buresch | 123/148 DC |
| 1,482,080 | 1/1924 | Lea | 123/148 D |
| 2,159,968 | 5/1959 | Fitzsimmons et al. | 123/148 D |
| 2,223,151 | 11/1940 | Nadler et al. | 123/148 D |
| 3,047,728 | 7/1962 | Martin | 123/148 DC X |
| 3,324,351 | 6/1967 | Pahl, Jr. | 315/224 X |
| 3,718,124 | 2/1973 | Burley | 123/148 DC |

*Primary Examiner*—Charles J. Myhre
*Assistant Examiner*—Tony Argenbright

[57] ABSTRACT

An ignition device for an internal combustion engine of the kind having an ignition coil comprising a primary winding and a secondary winding, a current limiting resistance connected in series with the primary winding and a contact breaker, wherein there is provided means which shunt said current limiting resistance for a predetermined time at each closure of the contacts of said contact breaker.

5 Claims, 4 Drawing Figures

IGNITION DEVICE FOR INTERNAL COMBUSTION ENGINES

The present invention relates to an ignition device for internal combustion engines, particularly for engines used in motor vehicles, in which the ignition circuit has an additional resistance in series with the primary winding of an ignition coil, the object of which resistance is to avoid over-heating of the coil by limiting the strength of the current which flows through it.

In certain known devices, this additional resistance is shunted when the internal combuston engine is started up, and in other known devices at a high rotation speed of the engine. Now, whatever may be this speed of rotation, such resistance is disadvantageous when the current is established in the primary winding of the coils, that is to say when the contact breaker is closed, since it substantially limits the current passing through the primary winding and considerably diminishes the energy of the spark at the spark plugs, and especially at a high speed of rotation of the engine.

The object of the present invention is to provide an ignition device which overcomes this disadvantage.

In accordance with the invention, there is provided an ignition device particularly for an internal combustion engine intended for use in motor vehicles, comprising an ignition coil, having, on the one hand, a low voltage primary winding which is supplied in use by a battery through a contact switch, and which is controlled by an ignition key and through an ignition contact breaker and, on the other hand, a high voltage secondary winding which in use is connected consecutively by means of a distributor to the engine spark plugs, a current limiting resistance in series with said primary winding of the coil, characterised in that there is provided means which shunt said current limiting resistance at each closure of the contacts of the ignition contact breaker for a predetermined time.

The description which follows with reference to the accompanying drawings will make clear how the invention may be carried out.

Figure 1:
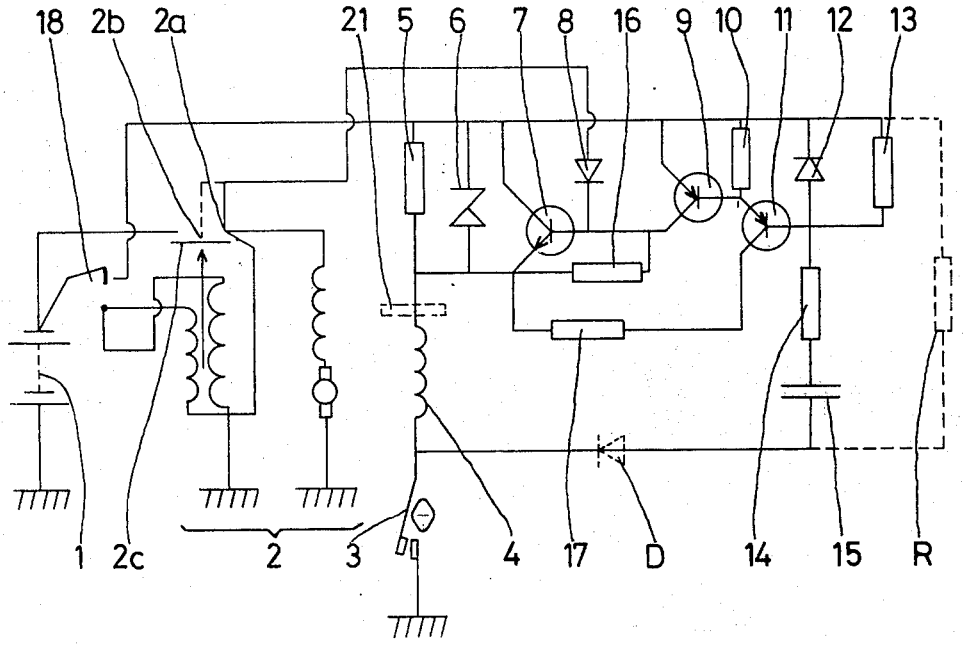
FIG. 1 shows diagrammatically one example of an ignition device according to the invention.

The device shown in FIG. 1 comprises, in known manner, a battey 1 which, by means of a contactor 18, supplies, on the one hand the starter 2 and, on the other hand, an ignition device including particularly the primary winding 4 of an ignition coil, an additional resistance 5 and a contact breaker 3. There is also provided a timing and switching device which is associated with the ignition device.

This device is constituted in the following manner: The collector of a transistor 7 of the NPN type, is connected to the highest potential of the resistance 5, and its emitter to the lowest potential of this same resistance. The base of this transistor 7 is connected to the collector of a transistor 9, of the PNP type. The emitter of this transistor 9 is also connected to the highest potential of the resistance 5, and its base is connected to the emitter of the transistor 11, of the PNP type, the collector of which is connected to the emitter of the transistor 7 by means of a resistance 17 in order to avoid earthing. The base of the transistor 11 is connected, on the one hand to a diode 12 which is also connected to the highest potential of the resistance, and which protects the emitter base junction of the transistor 11, and, on the other hand, to a resistance 13 also connected to the highest potential of the resistance 5, and finally to an RC circuit comprising resistance 14 and capacitor 15, in series, connected between the primary winding 4 of the coil and the contact-breaker 3.

The base of the transistor 9 is associated with a resistance 10 in order to fix the potential of the base when the transistor 9 is blocked, and said resistance 10 is connected between the base of the transistor 9 and the highest potential of the resitance 5.

A resistance 16 connected between the base and the emitter of the transistor 7 fixes the potential of the base of this transistor when the remainder of the device is blocked.

A Zener diode 6, in parallel with the resistance 5, protects the mounting assembly by limiting overvoltages at the terminals of the resistance.

Figure 2:
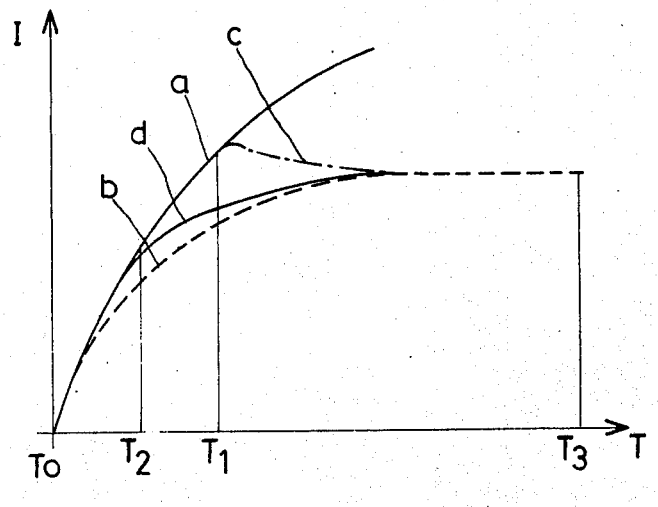
FIG. 2 shows the curves of the variations in strength of the current in the primary winding of the coil as a function of time.

The operation of this device is then as follows: As soon as the contact breaker 3 closes, at time To (see FIG. 2), a current is established in the device while the condensor15charges, making the amplifying transistor 11 conducting, which latter controls the switching transistor 9, which has itself also become conducting and which supplies the base of the amplifying transistor 7, making it conducting and which, thus, shunts the resistance 5, at the terminals of which there remains only a minimum residual voltage corresponding to the total of the junctions of the two transistors 9 and 7. The resistance does not then intervene in the ignition device and the current which flows through the primary winding 4 varies according to the curve *a* (FIG. 2) until time T1, at which time the condensor 15 is charged, blocking the transistor 11 and consequently the transistors 9 and 7. Current is thus established in he resistance 5 and causes the current which flows through the primary winding 4 to vary according to the curve *c* (FIG. 2). This curve is superimposed on the curve *b* which shows the variations in the current flowing through the primary winding 4 when the ignition device does not have the resistance shunting device.

When the contact breaker 3 opens, that is to say at the time T3 (FIG. 2) for low speeds of rotation of the engine, and T2 for high speeds of rotation of the engine, the condensor 15 discharges and the cycle starts again at each closure of the contact breaker 3.

It will be noted that at high speeds of rotation of the engine, i.e. for values of T lower than T1, the resistance is always shunted, the condensor 15 not having the time to become fully charged.

When starting, and particularly in the case where there is a large fall in the battery voltage, the resistance 5 uselessly decreases the already reduced performance of the coil; it is thus useful continually to shunt the resistance when starting up. To this end, the diode 8 connected between the positive pole of the starter, either 2*a* or 2*b* according to the starter used, and the base of the transistor 7, causes said transistor to become conducting throughout the starting operation, and the other elements of the device in this case play no part.

Another embodiment may be effected by replacing the transistor 11, the resistances 10 and 17 by a diode D (shown in broken lines in FIG. 1) connected, on the one hand, between the contact breaker 3 and the primary winding 4, and, on the other hand, to the negative pole of the condensor 15, and by a resistance R (in broken lines in FIG. 1) in parallel with the RC circuit and the resistance 13, the base of the transistor 9 being connected between the diode 12 and the resistance 14. The diode D thus avoids the removal of the ignition overvoltage appearing at the primary winding of the coil. The operation of this device is similar to that described above.

It is the same for a device comprising only the switching transistor 9, the collector of which is connected instead and in place of the emitter of the transistor 7, and the base instead and in place of the base of the transistor 11. Such a device thus comprises the transistor 9, the Zener diode 6, the resistances 13 and R, the diode D and the resistance-condensor timing circuit 14, 15. The diode 8 is thus connected to the collector of the transistor 9.

A device which has the same operation consists in adding only one condensor in parallel with the resistance 5. This device is economic and although giving better results (curve *d* in FIG. 2) than when the coil and the resistance 5 are alone, these results are inferior to those of the devices described above.

Figure 3:
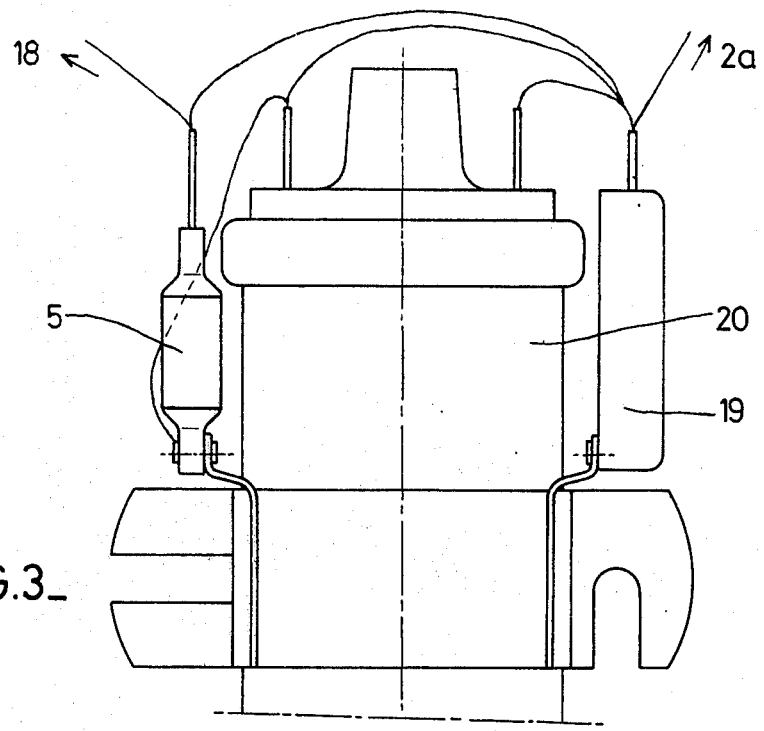
FIG. 3 shows an ignition coil to which is added an example of a timing and switching device in accordance with the invention.

An advantage of a timing and switching device as above-described lies in the fact that it is small, and that it can be inserted in a housing 19 fixed on the ignition coil 20 (FIG. 3). Alternatively, said device can be mounted in the head of the coil 20.

Figure 4:
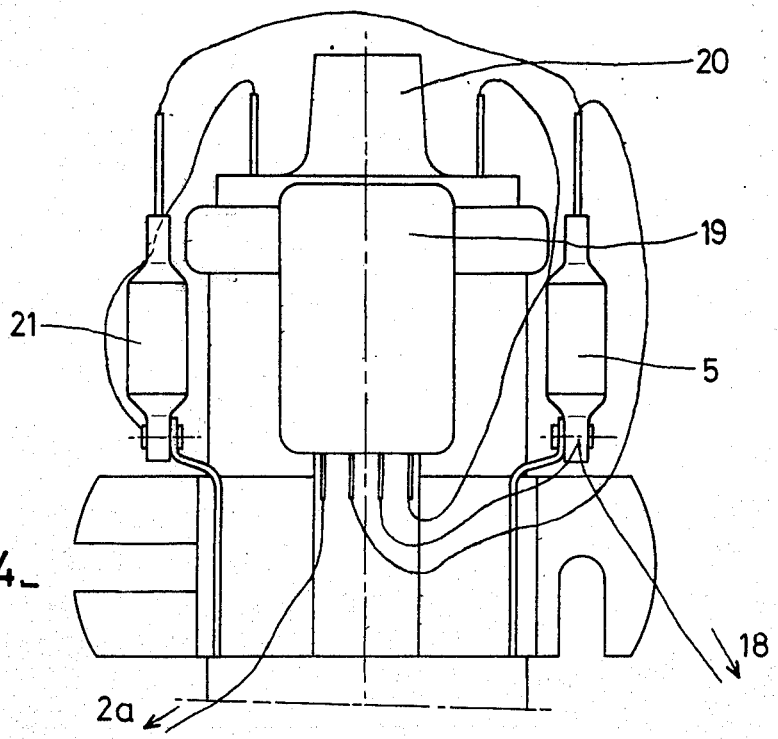
FIG. 4 is a variation of FIG. 3.

In an alternative embodiment, FIG. 4 shows a coil specially designed for high speeds, and which more particularly is useful for cars which must very often run on motorways. This coil, has, in kown manner, in addition to the resistance 5, a resistance 21 (broken lines, FIG. 1) of variable resistance, which varies with the temperature and consequently with the strength of current which flows through the primary winding of the coil.

In such a coil, only the resistance 5 is shunted, with the device described above, which allows the resistance 21 to act at high speeds when the primary current does not have the time to reach its maximum. The temperature thus decreases and with it the resistance 21 and the strength of the current in the primary winding increases, increasing the energy of the ignition spark.

It is understood that numerous modifications may be made to the devices described above, without however exceeding the scope of the invention, such as, for examle, the transposition of the respective positions of the resistance 14 and of the condensor 15.

I claim:

1. An ignition device for an internal combustion engine comprising: a contact breaker;

an ignition coil having a low voltage primary winding adapted to be connected to an electrical battery through said contact breaker; and a high voltage secondary winding adapted to be connected consecutively to engine spark plugs through a distributor;

a current limiting resistance connected in series with said primary winding; and electronic means connected in parallel with said resistance for shunting out said resistance for a specific predetermined time interval of the total time of closure of said contact breaker, independently of ambient temperature and engine speed.

2. An ignition device as claimed in claim 1 wherein said electronic shunting means consists of a timing circuit and a switching mechanism and is adapted to shunt-out said current-limiting resistance for a predetermined period of time following closing of said contact breaker.

3. An ignition device as claimed in claim 2 wherein said shunting means comprises a diode connected in parallel with said current-limiting resistor, and a network also connected in parallel with said current-limiting resistor, said network consisting of at least one transistor and at least one resistor.

4. An ignition device as claimed in claim 2 comprising a housing secured to a metallic fixing collar provided on said ignition coil for said electronic shunting means.

5. An ignition device as claimed in claim 1 comprising a temperature responsive resistance in series with said current-limiting resistance.

* * * * *